US011783966B2

(12) United States Patent
Shroyer

(10) Patent No.: US 11,783,966 B2
(45) **Date of Patent: *Oct. 10, 2023**

(54) FLAME AND HEAT RESISTANT, RELEASABLY CONNECTABLE WRAP FOR A PORTABLE RADIO, REMOTE SPEAKER MICROPHONE, AND THE CORD THEREBETWEEN

(71) Applicant: BreakThrough Innovations, LLC, Bellbrook, OH (US)

(72) Inventor: Trent B. Shroyer, Bellbrook, OH (US)

(73) Assignee: BreakThrough Innovations, LLC, Bellbrook, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/506,820

(22) Filed: Oct. 21, 2021

(65) Prior Publication Data

US 2022/0044842 A1 Feb. 10, 2022

Related U.S. Application Data

(63) Continuation of application No. 16/678,295, filed on Nov. 8, 2019, now Pat. No. 11,183,318.
(Continued)

(51) Int. Cl.
*A62B 17/00* (2006.01)
*H01B 7/295* (2006.01)
(Continued)

(52) U.S. Cl.
CPC ..... *H01B 7/295* (2013.01); *A45C 3/001* (2013.01); *A45F 3/14* (2013.01); *A62B 17/003* (2013.01); *A41D 13/0012* (2013.01); *A41D 27/20* (2013.01); *A45C 2011/002* (2013.01); *A45F 2003/007* (2013.01); *A45F 2003/142* (2013.01); *A45F 2200/0516* (2013.01)

(58) Field of Classification Search
CPC . H01B 7/295; A62B 17/003; A45F 2003/007; A41D 27/20; A41D 13/0012
See application file for complete search history.

(56) References Cited

U.S. PATENT DOCUMENTS 5,168,582 A * 12/1992 Aldridge ..... A41F 3/00 2/229
5,189,746 A * 3/1993 Horie ..... A61G 1/01 5/628

(Continued)

*Primary Examiner* — Robert H Muromoto, Jr.
(74) *Attorney, Agent, or Firm* — FisherBroyles, LLP; Susan M. Oiler

(57) ABSTRACT

Flaps and wraps that provide heat and flame resistant properties to a remote speaker microphone (RSM) and its cord and firefighter turnout coats having the same are disclosed. The flaps have an elongate body of flame and heat resistant fabric having a head, a tail, opposing first and second major surfaces, an elongate edge encompassing the head and the tail that is sewn to the firefighter turnout coat to form a flap seam to a first of the two front sections proximate the neck section, and a first fastener positioned on the second major surface of the head and the tail at an edge opposite the flap seam. A second fastener, which is mateable to the first fastener, is fixedly attached to the firefighter turnout coat at a position under the flap when the flap is in an attached position.

20 Claims, 10 Drawing Sheets

Related U.S. Application Data

(60) Provisional application No. 62/757,918, filed on Nov. 9, 2018.

(51) Int. Cl.

| | |
|---|---|
| ***A45F 3/14*** | (2006.01) |
| ***A45C 3/00*** | (2006.01) |
| *A62B 5/00* | (2006.01) |
| *A45C 11/00* | (2006.01) |
| *A41D 27/20* | (2006.01) |
| *A41D 13/00* | (2006.01) |
| *A45F 3/00* | (2006.01) |

(56) References Cited

U.S. PATENT DOCUMENTS 5,404,577 A * 4/1995 Zuckerman ..... H04R 1/46 455/66.1
5,678,205 A * 10/1997 Gray ..... A42B 3/10 455/90.3
6,109,496 A * 8/2000 Andrew ..... A45F 3/00 224/660
6,255,650 B1 * 7/2001 Warner ..... G02B 27/017 250/339.04
6,849,849 B1 * 2/2005 Warner ..... G02B 23/125 250/332
9,161,581 B2 * 10/2015 Huckabee ..... A41D 27/201
9,409,044 B2 * 8/2016 Murray ..... A62B 17/00
9,476,963 B2 * 10/2016 Cyganski ..... G01S 3/146
9,606,375 B2 * 3/2017 Abreu ..... G02C 5/14
9,653,948 B2 * 5/2017 Polu ..... B60L 53/36
9,802,066 B2 * 10/2017 Murray ..... A62B 17/00
9,955,761 B2 * 5/2018 Maddox ..... A45C 11/00
10,466,510 B2 * 11/2019 Abreu ..... G02C 11/10
11,183,318 B2 * 11/2021 Shroyer ..... A45C 3/001
2002/0175197 A1 * 11/2002 Cummins ..... E01H 1/1206 224/675
2004/0045080 A1 * 3/2004 Lewis ..... A41D 13/01 2/456
2007/0017008 A1 * 1/2007 Snedeker ..... A41F 9/025 2/456
2007/0234462 A1 * 10/2007 Grilliot ..... A41D 13/01 2/81
2010/0117826 A1 * 5/2010 Reed ..... G06Q 10/08 340/539.32
2013/0099975 A1 * 4/2013 Cyganski ..... G08B 21/0263 342/432
2013/0147427 A1 * 6/2013 Polu ..... H02J 50/001 320/108
2013/0300535 A1 * 11/2013 Gorman ..... G08B 21/02 340/6.1
2013/0324047 A1 * 12/2013 Wells ..... H04R 5/033 455/563
2014/0059749 A1 * 3/2014 Fofana ..... A62B 17/006 2/457
2014/0131409 A1 * 5/2014 Jasey ..... A45F 3/047 224/576
2014/0295786 A1 * 10/2014 Maier ..... H04W 64/00 455/404.2
2015/0040300 A1 * 2/2015 Murray ..... A62B 17/003 2/455
2015/0047093 A1 * 2/2015 Huckabee ..... A41D 27/201 2/69
2016/0081446 A1 * 3/2016 Maddox ..... A45C 11/00 224/257
2016/0317846 A1 * 11/2016 Murray ..... A62B 17/003
2017/0207665 A1 * 7/2017 Polu ..... H03F 3/195
2018/0116316 A1 * 5/2018 Raymond ..... A45F 5/022
2018/0206606 A1 * 7/2018 Maddox ..... A45F 3/14
2019/0165612 A1 * 5/2019 Polu ..... H04B 5/0081

* cited by examiner

FLAME AND HEAT RESISTANT, RELEASABLY CONNECTABLE WRAP FOR A PORTABLE RADIO, REMOTE SPEAKER MICROPHONE, AND THE CORD THEREBETWEEN

RELATED APPLICATIONS

This application is a continuation of U.S. application Ser. No. 16/678,295, filed Nov. 8, 2019, which claims the benefit of U.S. Provisional Application No. 62/757,918, filed Nov. 9, 2018.

TECHNICAL FIELD

The present patent application relates to wearable, portable radios having remote speaker microphones in need of flame and heat resistant protection, and, more particularly, to a flame and heat resistant, releasably connectable wrap that seats against and around the portable radio, the remote speaker microphone and the cord therebetween.

BACKGROUND

Firefighters and other first responders, such as Emergency Medical Services ("EMS") personnel and police officers, frequently carry portable radio equipment to facilitate real-time communication with other members of a response team at the scene of an emergency situation. This radio equipment includes the radio unit itself, as well as a remote speaker microphone ("RSM") attached to the radio unit via a cord, which is positioned proximate to the lapel of the wearer or across the back of the wearer. Firefighters are often exposed to extreme temperatures. Accordingly, the radio, RSM, and cord can benefit from protections against melting/heat damage, as well as protections against entanglement with objects in the environment.

Accordingly, those skilled in the art continue to seek improved fire resistance (heat and flame resistance) for the radio equipment without detracting from the functionality of the items.

SUMMARY

In all aspects, wraps providing hear and flame resistant properties to a portable radio, a remote speaker microphone, and a cord therebetween are disclosed that have an elongate body having a head and a tail, opposing first and second major surfaces that each have first and second elongate edges, and first and second elongate sides. The elongate body is made of flame and heat resistant fabric and has first fasteners positioned as a releasably mateable pair when the first and second elongate sides meet or overlap in a wrapped positioned. The head defines an opening therethrough positioned for alignment with a voice amplifier of a remote speaker microphone in the wrapped position, and the tail is wider than a width of the elongate body at a junction with the head. More specifically, the elongate body has a first width proximate the head and a second width proximate the tail, and the head has a third width, which is greater than the first width.

In all embodiments, the elongate body may taper divergently from the first width to the second with along the length of the elongate body and the releasably mateable pair of first fasteners is selected from hook-and-loop material, snaps, or a zipper. In all embodiments, a reflective strips may be present on the elongate body and/or the head, typically sewn thereto. And, the tail has notches in the first and second elongate sides at a position and shaped to fit a connector of a radio or a connector of a radio attachment member when in a wrapped position.

In one embodiment, the releasably mateable pair of first fasteners comprises hook-and-loop material on opposing first and second major surfaces of the elongate body proximate the first edge of the first major surface and the second edge of the second major surface.

In all aspects, the heat and flame resistant fabric may include a thermal barrier layer and/or a moisture barrier layer, with the flame and heat resistant fabric being the outermost layer of the wrap. The flame and heat resistant fabric resists igniting, burning, melting, dripping and/or separation at a temperature of 500° F. for at least five minutes.

In any of the embodiments disclosed herein, the wrap may include an elastic member releasably or fixedly attached to the head at a position that places the elastic member at the back of the remote speaker microphone in the wrapped position. A free end of the elastic member has a first fastener of a second pair of releasably attachable fasteners, and a second fastener is positioned between the opening of the head and the elongate body or positioned on the elongate body proximate the junction to the head. The second fastener is mateable to the first fastener of the second pair of releasably attachable fasteners. Additionally, a flap can be connected to the elastic member to fold over a top of a remote speaker microphone in the wrapped position.

In another aspect, a firefighter turnout coat having a body portion defining sleeves, a back section, a two front sections releasably mateable to one another, and a neck section, and a wrap is sewn as a flap to a first of the two front sections proximate the neck section, thereby defining a flap seam. The flap provides heat and flame resistant properties to a remote speaker microphone and to a cord connected to the remote speaker microphone. The elongate body of the flap has a head and a tail and opposing first and second major surfaces. The head defines an opening therethrough positioned for alignment with a voice amplifier of the remote speaker microphone in a wrapped position. The elongate body has a first fastener positioned on the first major surface or a second major surface of the head at an edge opposite the flap seam and a second fastener positioned on the second major surface of the elongate body at an edge opposite the flap seam. A third fastener which is mateable to the first and the second fasteners is fixedly attached to the first front section and positioned to mate with the first and second fasteners of the wrap.

The flap sewn to the turnout coat has many of the features mentioned above. The elongate body has a first width at a junction with the head and the head has a width that is wider than the first width. The first and second fasteners and the third fastener comprises hook-and-loop material or snaps.

In all embodiment, the flap may have a reflective strip(s) on the elongate body and/or the head. An elastic member may be releasably or fixedly attached to the head of the wrap at a position that places the elastic member at the back of the remote speaker microphone in the wrapped position. A free end of the elastic member has a fourth fastener releasably attachable to a fifth fastener positioned between the opening of the head and the elongate body or positioned on the elongate body proximate the junction to the head.

The third fastener has a first end fixedly attached to the first front section underneath the wrap juxtaposed to the flap seam and a second end fixedly attached to the first front section underneath the wrap at a position aligned with the second fastener of the wrap and the body is positionally curved therebetween.

DETAILED DESCRIPTION

Figure 1:
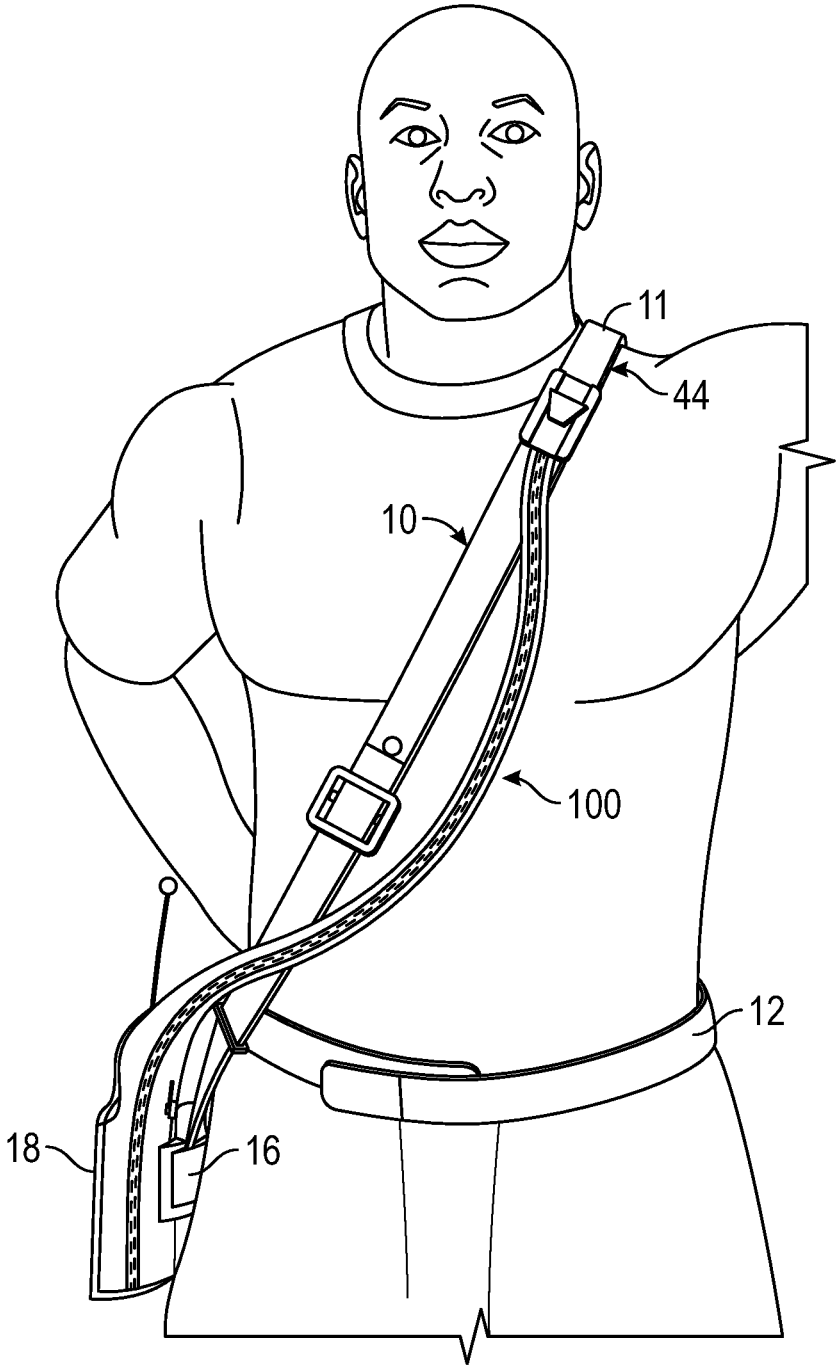
FIG. 1 is a front, perspective view of a wearer of a portable radio having a wrap providing heat and flame resistant properties to the radio, cord, and microphone.

The following detailed description will illustrate the general principles of the invention, examples of which are additionally illustrated in the accompanying drawings. In the drawings, like reference numbers indicate identical or functionally similar elements.

Figure 2:
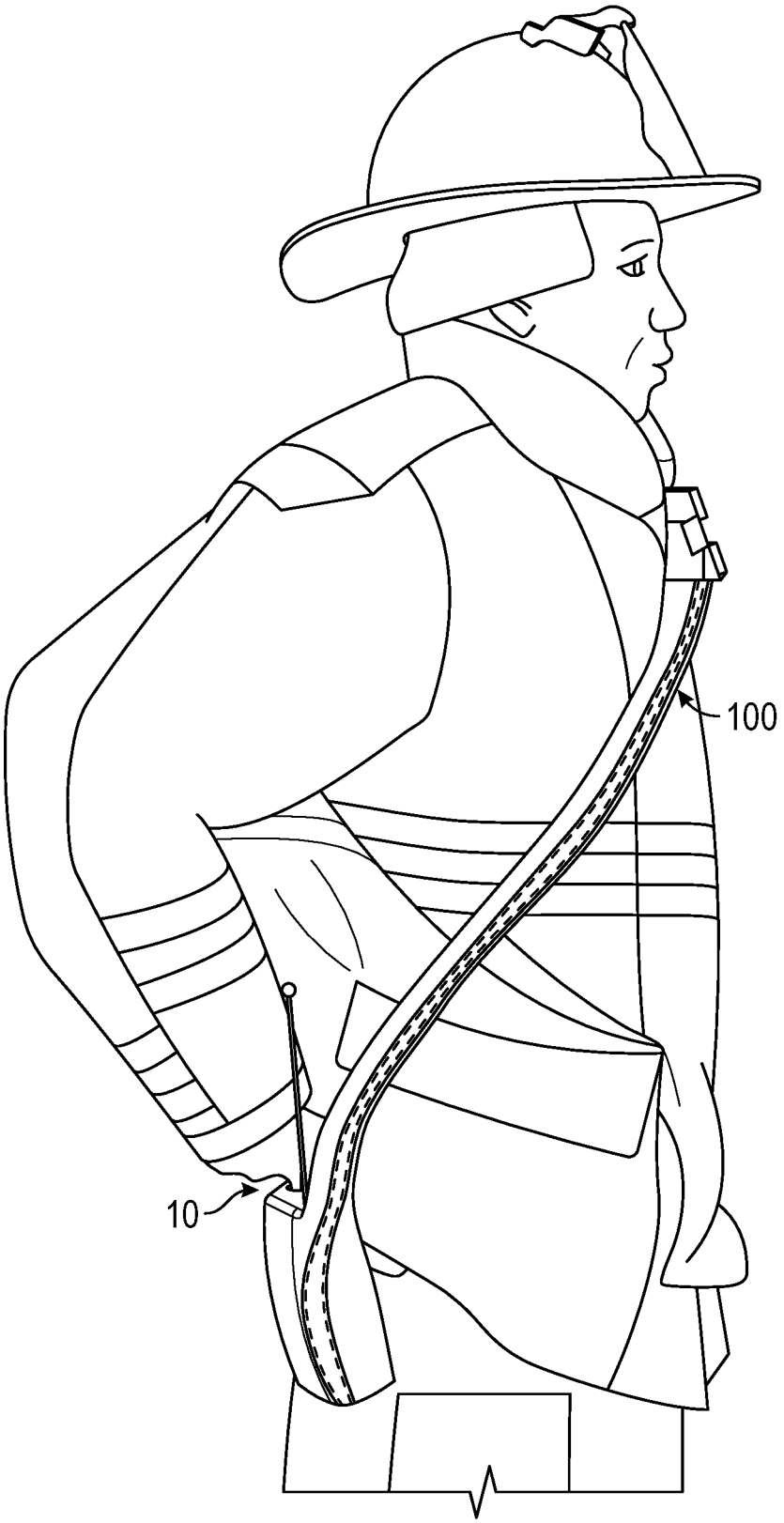
FIG. 2 is a side, perspective view of a wearer of a portable radio having a wrap providing heat and flame resistant properties to the radio, cord, and microphone.

Referring to FIGS. 1 and 2, a wrap 100 for a wearable radio support system 10 is disclosed. With reference to FIG. 1, the support system 10 includes a shoulder strap 11 typically worn like a sash and a radio attachment member 16, which may be coupled to the shoulder strap 11 and tethered to a belt 12 of the wearer or coupled to the belt 12 and the shoulder strap 11. The support system 10 may be as one as disclosed in U.S. Pat. No. 9,955,761. A RSM releasably attaches to the shoulder strap 11 proximate the neck and shoulder of the wear within an appropriate distance from the wearer's mouth and ear. In use, the radio 18 should be positioned to extend below the bottom of the user's coat with the antenna canted away from the user's body, thereby enabling quality signal transmission. The shoulder strap may be made of a variety of materials such as leather, a military-grade, nylon webbing, or those materials used for SCBA webbing having Kevlar® material, PBI® material, and/or Nomex® material therein, that provide enhanced strength and durability, including resistance to high temperatures.

As shown in FIG. 1, the wrap 100 covers the radio within the radio attachment member 16, the RSM, and the cord for electronic communication therebetween to provide flame and heat resistance to the radio system. As shown in FIG. 2, the wrap 100 is of a preselected width enabling the wrap to cover the portion of the shoulder strap 11 extending from the radio holder to the shoulder across the front of the wearer as well as the radio within the radio attachment member 16, the RSM, and the cord therebetween. While the illustrations demonstrate the cord worn across the front of the wearer, the wearer may also wear the cord across their back and utilize the wrap 100.

Figure 3:
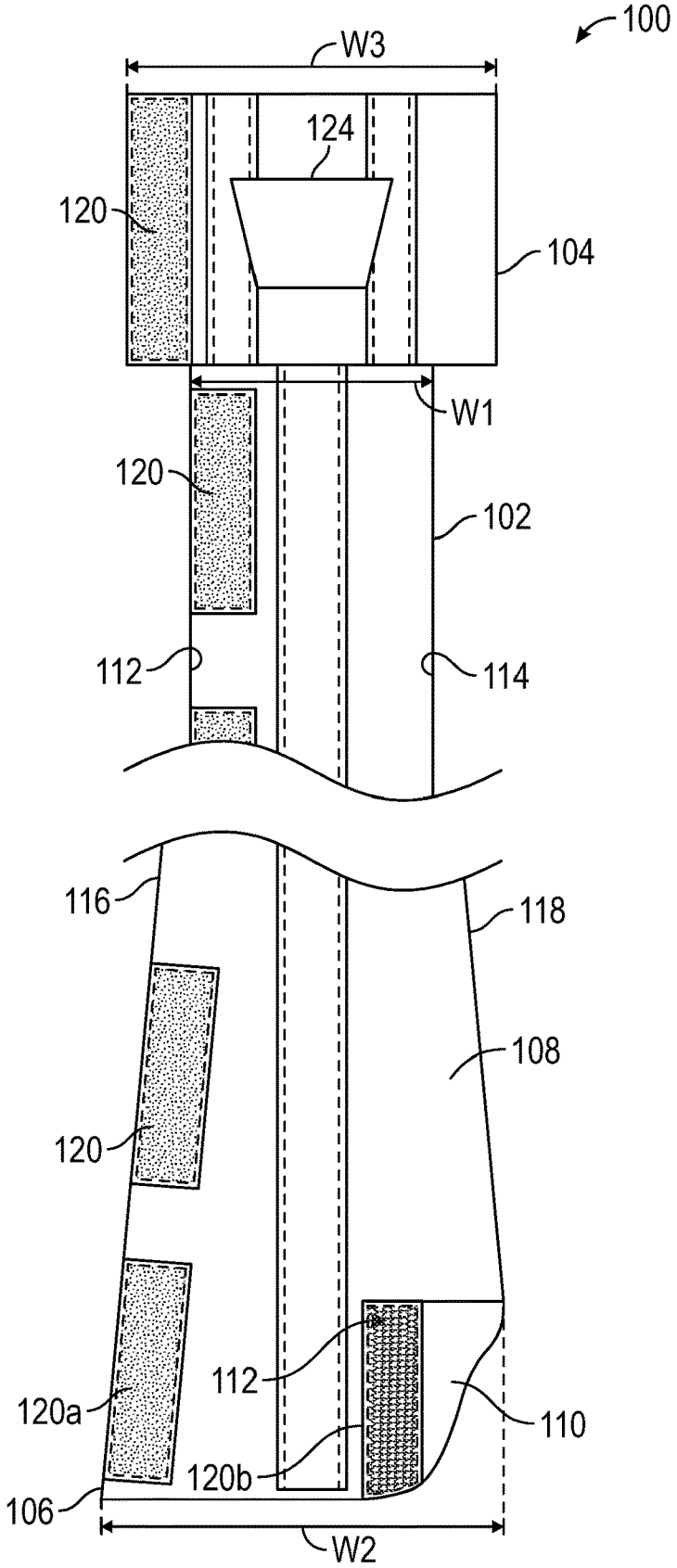
FIG. 3 is a top plan view of the an embodiment of a wrap having hook-and-loop fasteners in an open, unwrapped position.
Figure 4:
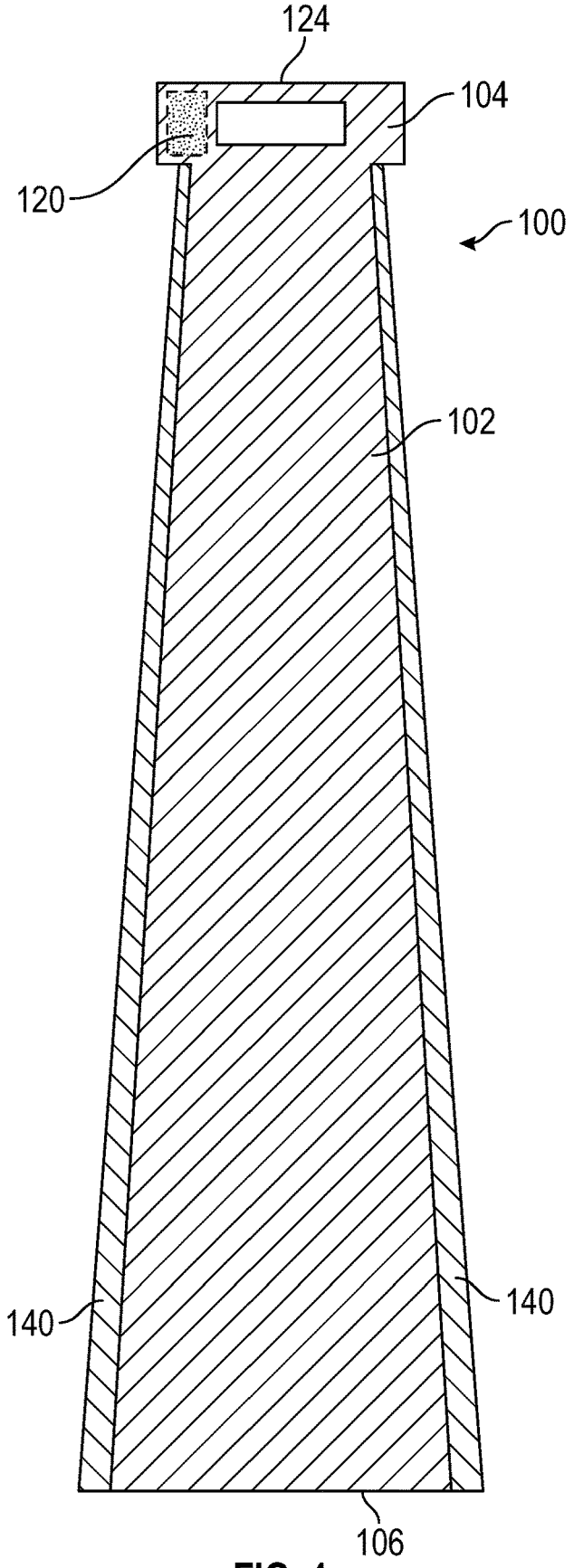
FIG. 4 is a top plan view of an embodiment of a wrap having a zipper in an open, unwrapped position.

Referring now to the two embodiment of FIGS. 3 and 4, the wrap 100 has an elongate body 102 having a head 104 and a tail 106. The head 104 of the wrap 100 defines an opening 124 therethrough positioned for alignment with a voice amplifier of a remote speaker microphone when the wrap is in a wrapped position about the cord and the RSM. The elongate body 102 has a first width W1 at a junction with the head 104, a second width W2 at the tail 106, and a third width W3 for the head 104. The second width W2 of the tail 106 is wider than the first width W1 of the elongate body 102 at a junction with the head and the third width W3 of the head is wider than the first width and is narrower than the second width. As most clearly illustrated in FIG. 4, the elongate body 102 tapers divergently from the first width W1 to the second width W2 along the length thereof.

The first width W1 is in a range of about 3 inches to about 8 inches. The second width W2 is in a range of about 3 inches to about 14 inches, more preferably about 5 inches to 12 inches. The third width W3 is in a range of about 3 inches to about 14 inches, more preferably 4 inches to 10 inches. "About" as used herein is for any value means within plus or minus 10% of the stated value, or more preferably plus or minus 5% of the stated value.

The wrap 100 has opposing first major surface 108 and second major surface 110 spaced apart from one another by first and second elongate sides 116, 118. Each of the first and second major surfaces 108, 110 have a first elongate edge 112 and a second elongate edge 114. First fasteners 120 are positioned as a releasably mateable pair when the first and second elongate sides 116, 118 meet, for example as halves of a zipper 140 as shown in FIG. 4, or overlap in a wrapped positioned, for example by mating the hook-and-loop fasteners 120*a*, 102*b* shown in FIG. 3. While the embodiments of FIGS. 3 and 4 illustrate hook-and-loop fasteners and a zipper as a first fasteners, other types of fasters are equally possible. For example, the releasably mateable pair of first fasteners can be hook-and-loop material, zippers, snaps, buttons, ties, hook and eyes and combinations thereof, all of which are preferably rated as being heat and flame resistant by the manufacturer. In FIG. 3, while zipper 140 is the fastener for the elongate body, a hook-and-loop material 120*a*, 120*b* is the fastener for the head 104.

Turning to FIG. 3, the wrap 100 has heat and flame resistant mating hook-and-loop material 120*a*, 120*b* on opposing first and second major surfaces 108, 110 of the elongate body 102 proximate the first edge 112 of both of the first major surface 108 and the second major surface 110. The first edge 112 is the edge positioned to the left from the viewer's perspective when the respective side of the wrap is facing the viewer in the orientation shown in FIG. 3. The hook-and-loop material 120*a*, 120*b* may extend the entire length of the elongate body 102 and/or head 104 or comprise a plurality of segments as shown in FIG. 3 position periodically along the length of the elongate body 102 and the head 104.

As shown in FIGS. 1-3, the wrap 100 can include reflective material 160 positioned to be outwardly visible in the wrapped position. The reflective material 160 may be an elongate strip generally centered along the length of the elongate body 102 or a plurality of strips running the length or across the width in a preselected ornamental orientation.

The head may include a plurality of strips of reflective material oriented transverse to the width or parallel to the width thereof.

Figure 5:
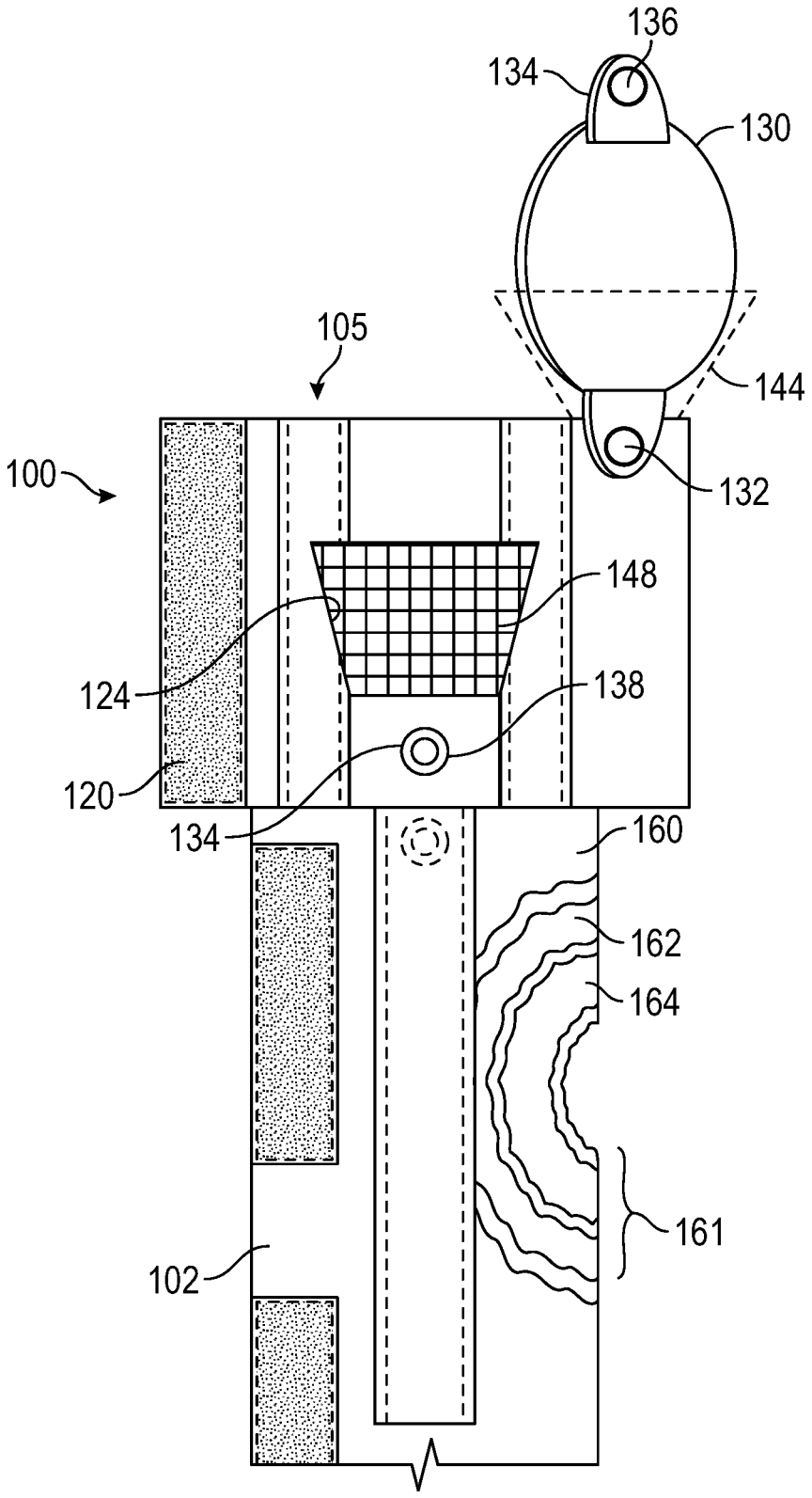
FIG. 5 is a partial, top plan view of features of any of the wraps disclosed herein.

Turning now to FIG. 5, the head 104 of wrap 100 in the wrapped position will have an open top end 105 to provide access to the typical position of controls of the RSM. To add some rigidity and security to the wrapped position at the head 104, the head 104 includes an elastic member 130 releasably or fixedly attached to the head 104 at a position 132 that places the elastic member 130 at the back of the remote speaker microphone in the wrapped position. The elastic member 130 has a first member 136 of a second pair of releasably attachable fasteners 134 at an end opposition position 132. The head 104 has the second member 138 of the second pair of releasably attachable fasteners 134 at a position that stretches the elastic member to secure the open end 105 of the wrap. The second member 138 is illustrated as positioned between the opening 124 and the elongate body 102. In an alternate embodiment, the second member 138 may be positioned on the elongate body as illustrated by the dashed version in FIG. 5. The elastic member 130 may be an endless loop of elastic cord, two lengths of elastic cord, one or more strips of an elastic strap, or any other form of elastic material. Preferably, the elastic member is heat and flame resistant.

Still referring to FIG. 5, the head 104 may include a flap 144 of heat and flame resistant material connected to the elastic member 130 proximate the first member 136 of the second pair of releasably attachable fasteners and shaped to fold over the top of the RSM in the wrapped position to close the open top end 105 of the wrap. The opening 124 within the head 104 can include a mesh material 148 covering the area defined by the opening. This will add some additional stability and rigidity to the head portion of the wrap 100.

With reference to FIG. 5, all or part of the components disclosed herein for all aspects of wrap 100 include a variety of materials, including a fire retardant material or a flame, heat, and abrasion resistant material such as a compact weave of aramid fibers and/or polybenzamidazole fibers, especially the outer shell 160. Commercially available aramid materials include NOMEX and KEVLAR fibers (both trademarks of E.I. DuPont de Nemours and Company, Inc. of Wilmington, Del.), and commercially available polybenzamidazole fibers include PBI fibers (a trademark of PBI Performance Fabrics of Charlotte, N.C.). Thus, the components disclosed herein may be an aramid material, a blend of aramid materials, a polybenzamidazole material, a blend of aramid and polybenzamidazole materials, or other appropriate materials. If desired, the components may have portions thereof coated with a polymer or coated with a durable, water repellent finish (i.e. a perfluorohydrocarbon finish, such as TEFLON® finish sold by E. I. Du Pont de Nemours and Company, Inc. of Wilmington, Del.).

Beneath the outer shell 160, a liner 161 may be present. The liner 161 includes a moisture barrier 162 and/or a thermal liner 164. The moisture barrier may between the outer shell 160 and the thermal liner 164, or the positions of the moisture barrier 28 and thermal liner 30 may be reversed such that the thermal liner 30 is located between the outer shell 160 and the moisture barrier 162. The moisture barrier 162 and thermal liner 164 may be coextensive with the outer shell 160 or spaced slightly inwardly from the outer edges of the outer shell 160 (e.g., spaced slightly inwardly from the edges 112 and 114) to provide moisture and thermal protection throughout the wrap 100. The moisture barrier 162 may include a semi-permeable membrane layer and a substrate as taught in U.S. Pat. No. 7,913,322. The semi-permeable membrane layer may be made of or include expanded polytetrafluoroethylene ("PTFE") such as GORE-TEX or CROSSTECH materials (both of which are trademarks of W. L. Gore & Associates, Inc. of Newark, Del.), polyurethane-based materials, neoprene-based materials, cross-linked polymers, polyamide, or other materials. The semi-permeable membrane layer may have microscopic openings that permit moisture vapor (such as water vapor) to pass therethrough, but block liquids (such as water) from passing therethrough. The semi-permeable membrane layer may be made of a microporous material that is either hydrophilic, hydrophobic, or somewhere in between and may be monolithic and allow moisture vapor transmission therethrough by molecular diffusion.

The semi-permeable membrane layer may be bonded or adhered to the substrate, which is preferably a flame and heat resistant material. The substrate may be or include aramid fibers similar to the aramid fibers of the outer shell 160, but may be thinner and lighter in weight. The substrate may be woven, non-woven, spunlace or other materials.

The thermal liner 164 may be made of any suitable material that provides sufficient thermal insulation. In one embodiment, the thermal liner 164 includes a relatively thick (i.e., between about 1/16"-3/16") batting, felt, or needled non-woven material which can include aramid fiber batting (such as NOMEX batting), aramid needle-punch material, an aramid non-woven material, an aramid blend needle-punch material, an aramid blend batting material, an aramid blend non-woven material, or foam (either open cell or closed cell) materials. The batting, felt, or needled non-woven material is often a quilted material. In one embodiment, the thermal liner 30 may have a thermal protection performance ("TPP") of at least about twenty, or of at least about thirty-five.

Each of these materials, and the components disclosed together as a whole to define the wrap 100, meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the components must be able to resist igniting, burning, melting, dripping and/or separation at a temperature of 500° F. for at least five minutes.

In all aspects, the wrap 100 is constructed of a length of flexible, heat and flame resistant material that extends from the base of a radio within the radio attachment member 16 to the top of the RSM in small, medium, large, and extra-large sizes. In one embodiment, the length of the wrap 100 is at least about 10 inches long to a max of about 48 inches long. The length of the wrap may be adjustable.

Figure 6:
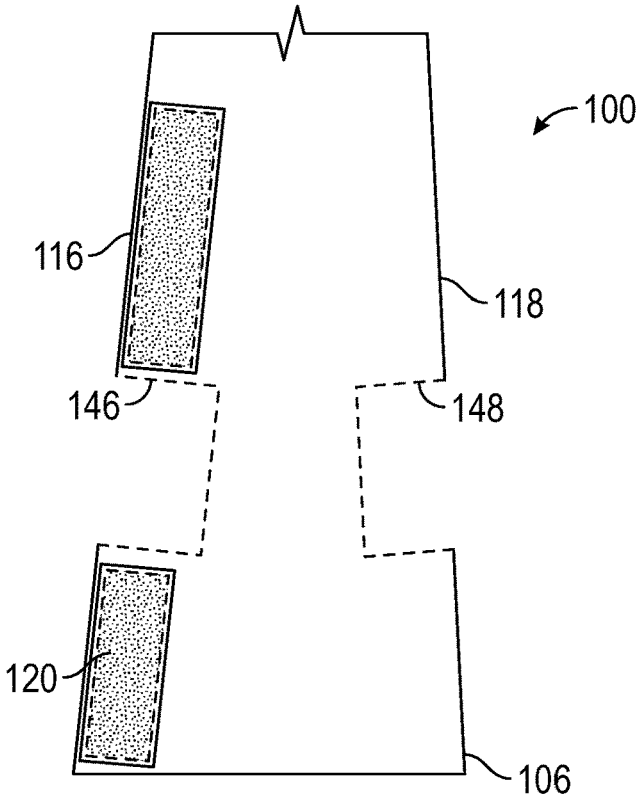
FIG. 6 is a partial, top plan view of the tail portion of a wrap.
Figure 7:
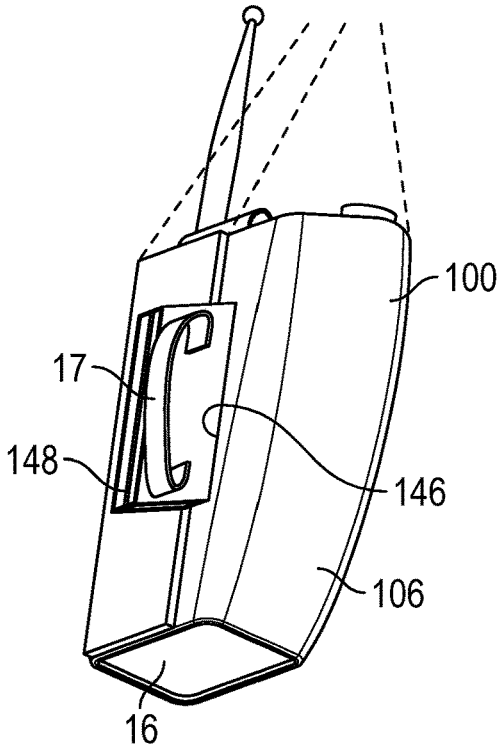
FIG. 7 is a rear, perspective view of the wrap of FIG. 6 in the wrapped position about a radio.

Turning now to FIGS. 6 and 7, the tail 106 of the wrap 100 is illustrated in an unwrapped position and a wrapped position, respectively. In each of the first and second elongate sides 116, 118 are notches 146 and 148 defining voids. The notches 146, 148 are proximate the tail at a position preselected to fit a connector 17 of the radio attachment member 16 or a connector on the radio itself, e.g., when no radio attachment member 16 is present, within the void defined by the notches 146, 148 in the wrapped position. In FIG. 7, the first fasteners 120 above and below the notches 146, 148 are mated with their respective second member with the notches aligned such that the connector 17 protrudes outward from the void defined by the notches. The wrap 100 may or may not cover the radio antennae.

Figure 8:
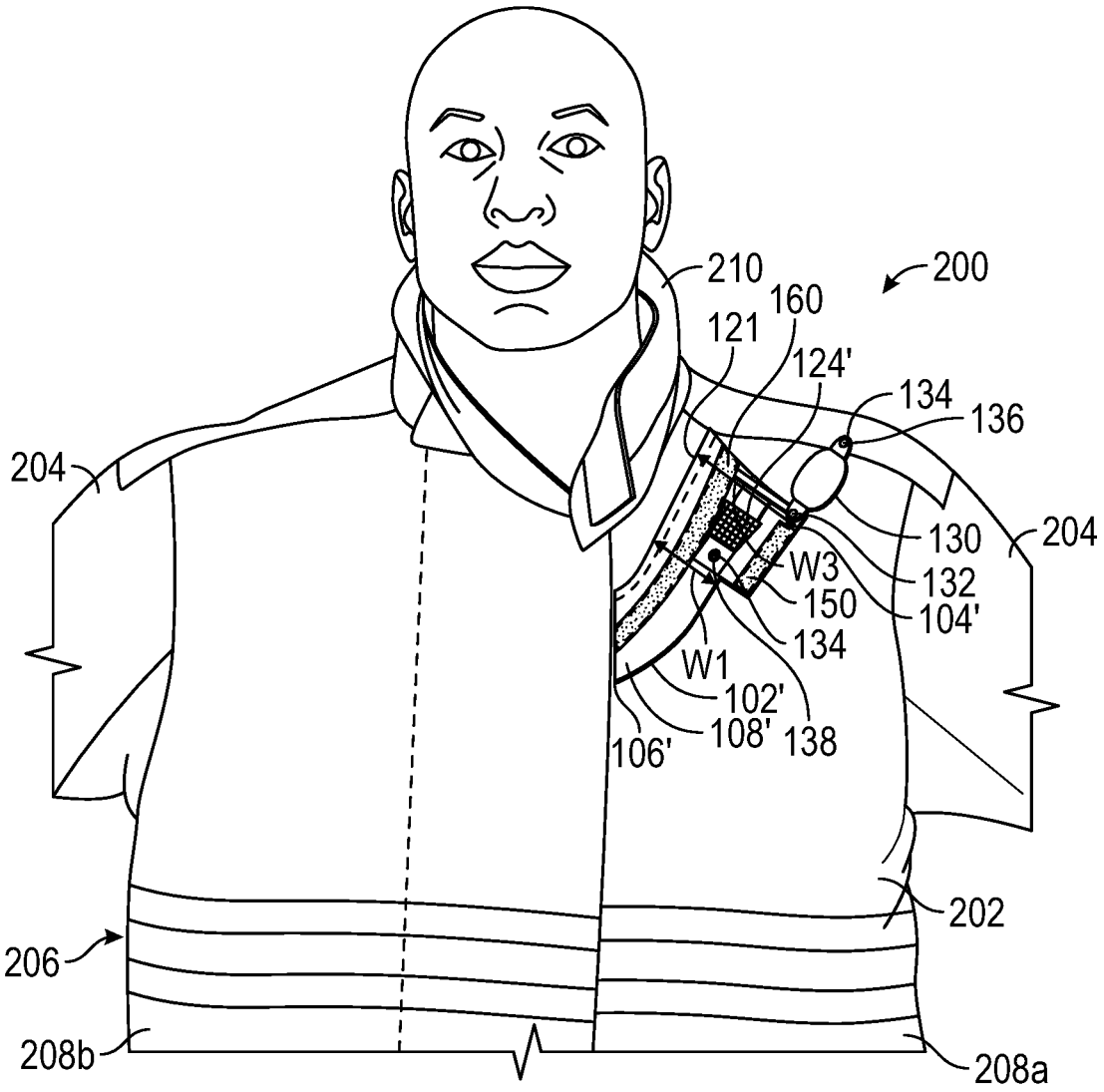
FIG. 8 is a front view of a firefighter's turnout coat having a wrap sewn to a front section thereof, as a flap, proximate a neck section.
Figure 9:
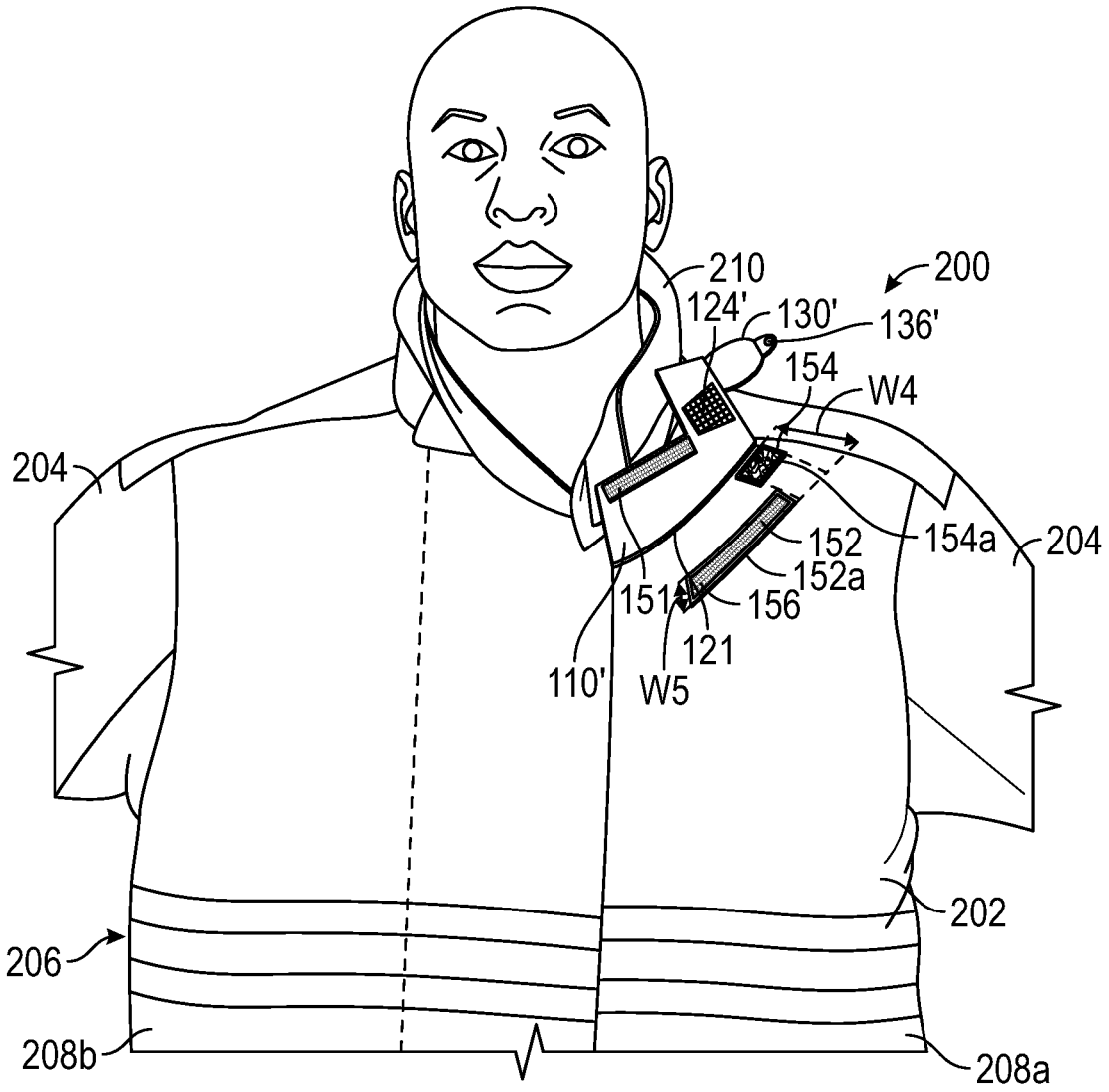
FIG. 9 is a front view of the firefighter's turnout coat of FIG. 8 with the wrap flipped up to show the back side of the wrap.

Turning now to FIGS. 8 and 9, a firefighter turnout coat 200 has a wrap 100' fixedly attached thereto as a flap, thereby defining a flap seam 121. The turnout coat 200 has a body portion 202 defining a back section 206, two front sections 208*a*, 208*b* that are releasably mateable to one another, for example by a zipper, hook-and-loop fasteners, or snap, and a neck section 210. The wrap 100' provides heat and flame resistant properties to the remote speaker microphone and to its cord, which is often worn under the turnout coat 200 and emerges from between the two front sections 208*a*, 208*b*. The RSM typically connects to the coat proximate a shoulder and neck of the wearer. The wrap 100' is sewn as a flap to a first of the two front sections 208*a* proximate the neck section. Proximate as used herein includes at the neck section and close to the neck section. In FIG. 8, the wrap is illustrated as fixedly attached close to the neck section, but it is understood that the flap may be at or built into the seam joining the neck section to the first body section.

The wrap 100' has an elongate body 102' of flame and heat resistant fabric having a head 104' and a tail 106' and opposing first and second major surfaces 108', 110'. The elongate body 102' has a first width W1 at a junction with the head 104' and the head has a width W2 that is wider than the first width W1. The head 104' defines an opening 124' therethrough positioned for alignment with a voice amplifier of the remote speaker microphone in a wrapped position. The elongate body 102' has a first fastener 150 positioned on the first major surface 108' of the head 104' at an edge opposite the flap seam 121 and a second fastener 151 positioned on the second major surface 110' of the elongate body 102' at an edge opposite the flap seam 121. A third fastener 152 which is mateable to the first and the second fasteners 150, 151 is fixedly attached to the first front section 208*a* and positioned to mate with the first and second fasteners 150,151 of the wrap 100'. The first, second, and third fasteners 150, 151, 152 are preferably heat and flame resistant hook-and-loop fasteners, but is not limited thereto. In another embodiment, the first, second, and third fasteners may be snaps.

Referring now to FIG. 9, the third fastener 152 may be an elongate single piece of hook-and-loop material having a head 154, as represented by the solid and dashed portion of the hook-and-loop fastener, and a body portion 156 extending from the head and positioned by underneath the elongate body 102' of the wrap 100' at a position that mates with the second fastener 151. The head 154 is positioned under the head 104' of the wrap 100' at a position to mate with the first fastener 150 in the wrapped position about the RSM. In this embodiment, the head 154 of the third fastener 152 has a fourth width W4 that is wider than a fifth width W5 of the body portion 156 of the third fastener 152. Alternately, FIG. 9 shows the third fastener 152 as two pieces of hook-and-loop material having a first piece 154*a* juxtaposed to the flap seam 121 fixedly attached to the first body section 208*a* at a position underneath the head 104' of the wrap 100'. The second piece 152*a* is fixedly attached to the first body section 208*a*, independently of the first piece 154*a*, at a position underneath the elongate body 102' of the wrap 100' at a position spaced a distance apart from the flap seam 121 that enables the second piece 152*a* to mate with the second fastener 151.

Figure 10:
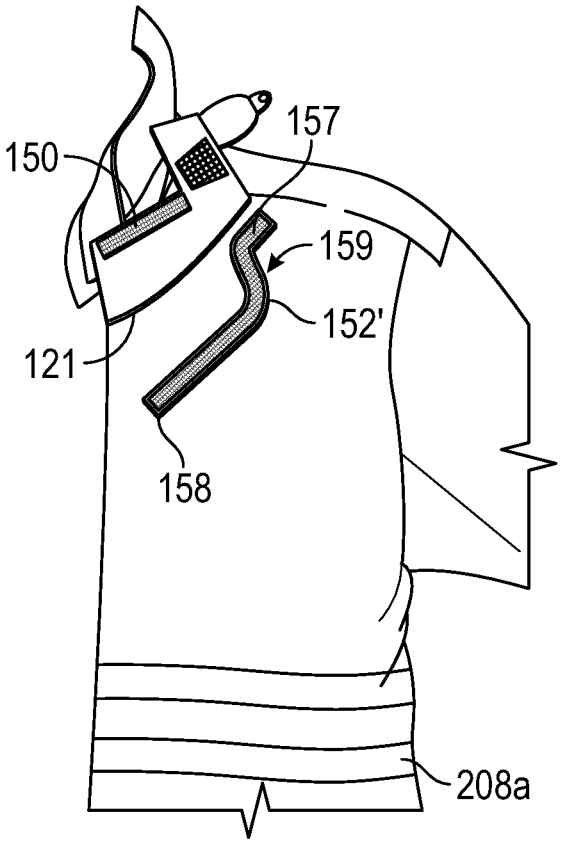
FIG. 10 is a front view of an alternate configuration for the third fastener fixedly attached to the firefighter turnout coat.

Referring now to FIG. 10, in another embodiment, the third fastener 152' is a continuous elongate strap of hook-and-loop fastener that has a first end 157 fixedly attached to the first front section 208*a* underneath the wrap 100' juxtaposed to the flap seam 121 and a second end 158 fixedly attached to the first front section 208*a* underneath the wrap 100' at a position aligned with the second fastener 151 of the wrap 100' and a portion of the continuous elongate strap between the first and second ends 157, 158 is positioned as a curve portion 159 to transition the ends 157, 158 to their offset positions, relative to one another. The third fastener 152' is fixedly attached to the turnout coat 200 by sewn stitching.

As shown in FIG. 8, the wrap 100' can include reflective material 160 positioned to be outwardly visible in the wrapped position. The reflective material 160 may be an elongate strip positioned adjacent to the flap seam 121, adjacent to the edge opposite the flap seam, or two elongate strips positioned in both positions, which extends all or a portion of the length of the elongate body 102' and head 104'.

Still referring to FIG. 8, the head 104' of wrap 100' in the wrapped position will have an open top end to provide access to the typical position of controls of the RSM. To add some rigidity and security to the wrapped position at the head 104', the head 104' includes an elastic member 130 releasably or fixedly attached to the head 104' at a position 132 that places the elastic member 130 at the back of the remote speaker microphone in the wrapped position. The elastic member 130 has a first member 136 of a second pair of releasably attachable fasteners 134 at an end opposition position 132. The head 104' has the second member 138 of the second pair of releasably attachable fasteners 134 at a position that stretches the elastic member to secure the open end of the wrap. The second member 138 is illustrated as positioned between the opening 124 and the elongate body 102. In an alternate embodiment, the second member 138 may be positioned on the elongate body as illustrated by the dashed version in FIG. 5. The elastic member 130 may be an endless loop of elastic cord, two lengths of elastic cord, one or more strips of an elastic strap, or any other form of elastic material. Preferably, the elastic member is heat and flame resistant.

Alternately, the head 104', as discussed above with respect to FIG. 5, may include a flap 144 of heat and flame resistant material connected to the elastic member 130 proximate the first member 136 of the second pair of releasably attachable fasteners and shaped to fold over the top of the RSM in the wrapped position to close the open top end of the wrap. The opening 124' within the head 104' can include a mesh material covering the area defined by the opening. This will add some additional stability and rigidity to the head portion of the wrap 100'.

Figure 11:
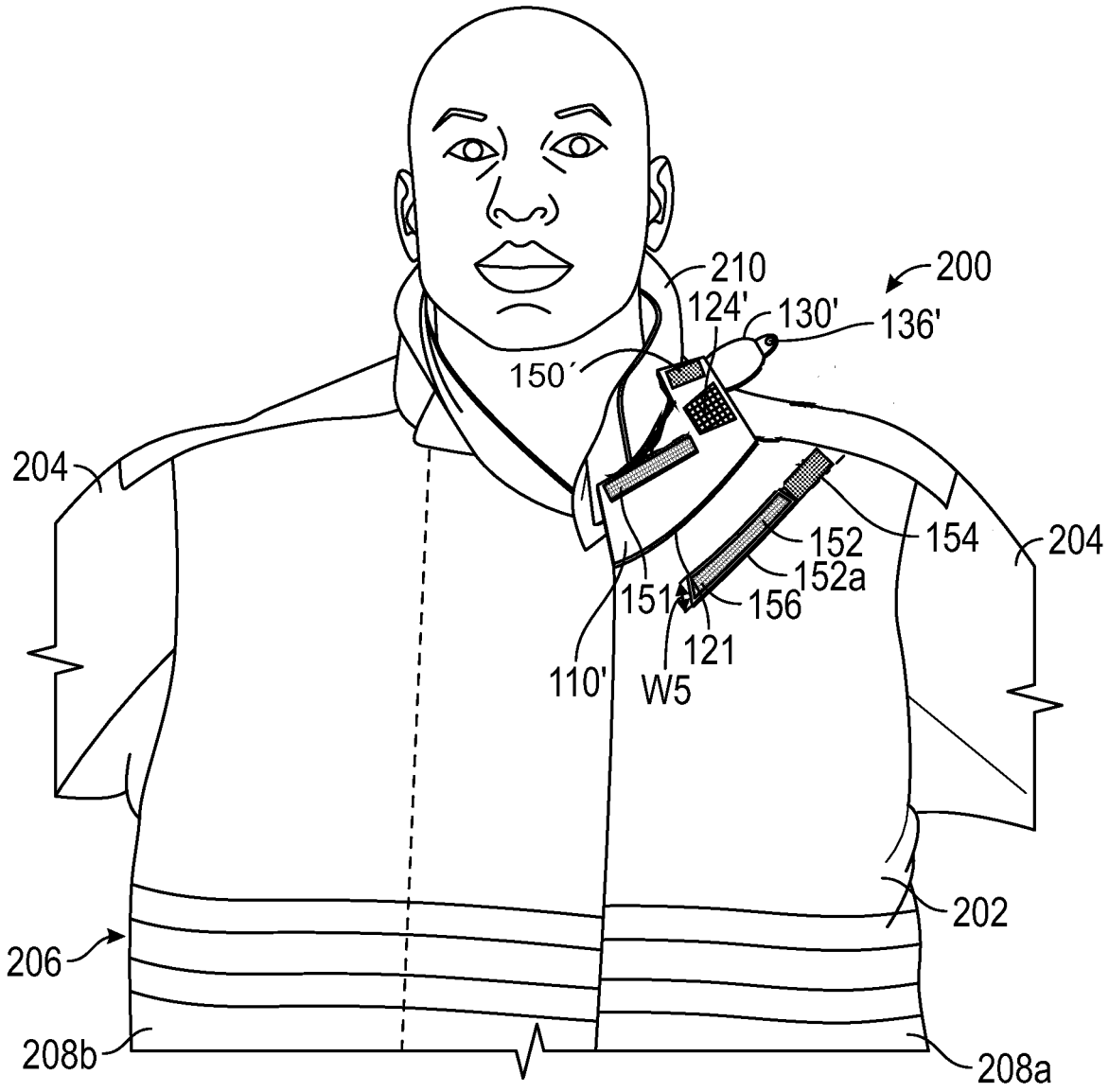
FIG. 11 is a front view of an another embodiment of a wrap sewn to a front section of a firefighter's turnout coat.

Referring now to FIG. 11, the wrap 100' fixedly attached to a firefighter's turnout coat 200, rather than have the first fastener 150 positioned on the first major surface 108' of the head 104', the first fastener 150' is positioned on the second major surface 110' of the head 104' at an edge opposite the flap seam 121. The third fastener 152 in this embodiment comprises a first fastener 152*a* and a second fastener 154, which are mateable to the first and the second fasteners 150', 151. The third fastener 152, while being illustrated as two pieces of hook-and-loop material may instead be a single piece of hook-and-loop fastener fixedly attached to the first front section 208*a* and positioned to mate with the first and second fasteners 15',151 of the wrap 100'. All the fasteners 150', 151, 152, 154 are preferably heat and flame resistant hook-and-loop fasteners, but is not limited thereto. In another embodiment, the fasteners may be snaps.

Further, in the embodiment of FIG. 11, the elongate body of the wrap 100' has an arcuate transition between the tail and the head rather than a ninety degree corner. The head

104' still has an overall width W3 that is greater than a width of the opposite end of the tail 106'.

With respect to all the embodiments of FIGS. 8-11, the orientation of the wrap is illustrated as being generally parallel to the neck seam to the body, and as discussed above, the wrap may be sewn in at the neck seam to the body. However, other orientations are possible as long as the RSM is positioned on the turnout coat at a position acceptable for operation of and operative communication by the wearer through the RSM. For example, the wrap may be oriented more parallel to the length of a shoulder section, i.e., more transvers to the mating seam of the first and second front sections 208*a*, 208*b* (such as, a zipper), or at some other orientation in-between the two orientations.

Each of the materials and components disclosed herein that together as a whole define the wrap 100', including the same material discussed above for wrap 100, meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the components must be able to resist igniting, burning, melting, dripping and/or separation at a temperature of 500° F. for at least five minutes.

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to preferred embodiments thereof, it will be apparent that modifications and variations are possible without departing from the scope of the invention which is defined in the appended claims.

What is claimed is:

1. A firefighter turnout coat comprising:

a body portion defining sleeves, a back section, two front sections releasably mateable to one another, and a neck section;

a flap comprising fabric having heat and flame resistant properties, the flap comprising:

an elongate body having a head and a tail, opposing first and second major surfaces that each have first and second elongate edges, and first and second elongate sides, wherein the elongate body comprises the fabric, has one of the first and second elongate sides, which encompasses the head and the tail, sewn to a first of the two front sections of the firefighter turnout coat proximate the neck section to form a flap seam, and has a first fastener positioned on the second major surface of the head and the tail at an edge opposite the flap seam; and a second fastener, which is mateable to the first fastener, is fixedly attached to the first of the two front sections of the firefighter turnout coat at a position that is under the flap when the flap is in an attached position;

wherein the head defines an opening therethrough positioned for alignment with a voice amplifier of a remote speaker microphone in the wrapped position; and wherein the tail is wider than a width of the elongate body at a junction with the head.

2. The firefighter turnout coat of claim 1, wherein the elongate body has a first width proximate the head and a second width proximate the tail, wherein the head has a third width, and the third width is greater than the first width.

3. The firefighter turnout coat of claim 1, wherein the elongate body tapers divergently from the first width to the second with along the length of the elongate body.

4. The firefighter turnout coat of claim 1, further comprising a reflective strip on the elongate body and/or the head.

5. The firefighter turnout coat of claim 1, further comprising a thermal barrier layer, wherein the flame and heat resistant fabric is the outermost layer of the flap.

6. The firefighter turnout coat of claim 5, further comprising a moisture barrier layer.

7. The firefighter turnout coat of claim 1, wherein the elongate body has a first width at a junction with the head and the width of the head is wider than the first width.

8. The firefighter turnout coat of claim 1, wherein the first and second fasteners each comprise hook-and-loop material or snaps.

9. The firefighter turnout coat of claim 1, wherein the flame and heat resistant fabric resists igniting, burning, melting, dripping and/or separation at a temperature of 500° F. for at least five minutes.

10. The firefighter turnout coat of claim 1, wherein the first fastener comprises a plurality of segments of hook-and-loop material.

11. The firefighter turnout coat of claim 1, wherein the flap seam is generally parallel to the neck seam to the first of the two front sections.

12. The firefighter turnout coat of claim 1, wherein the flap seam is built into the seam joining the neck to the first of the two front sections.

13. A firefighter turnout coat comprising:

a body portion defining sleeves, a back section, two front sections releasably mateable to one another, and a neck section; and a flap comprising fabric having heat and flame resistant properties, the flap comprising:

an elongate body having a head and a tail, opposing first and second major surfaces that each have first and second elongate edges, and first and second elongate sides that encompass the head and the tail, wherein the tail is wider than a first width of the elongate body at a junction with the head;

wherein the elongate body has one of the first and second elongate sides sewn to a first of the two front sections of the firefighter turnout coat proximate the neck section to form a flap seam, and has a first fastener positioned on the second major surface of the elongate body at an edge opposite the flap seam; and a second fastener, which is mateable to the first fastener, is fixedly attached to the first of the two front sections of the firefighter turnout coat at a position that is under the flap when the flap is in an attached position.

14. The firefighter turnout coat of claim 13, wherein the elongate body has a second width proximate the tail and the head has a third width, wherein the third width is greater than the first width.

15. The firefighter turnout coat of claim 14, wherein the elongated body has an arcuate transition between the tail and the head.

16. The firefighter turnout coat of claim 13, wherein the elongate body tapers divergently from the first width to the second with along the length of the elongate body.

17. The firefighter turnout coat of claim 13, wherein the first and second fasteners each comprise mating hook-and-loop material or snaps.

18. The firefighter turnout coat of claim 13, wherein the elongated body has an arcuate transition between the tail and the head.

19. The firefighter turnout coat of claim 13, wherein the flap seam is generally parallel to the neck seam to the first of the two front sections.

20. The firefighter turnout coat of claim 13, wherein the flap seam is built into the seam joining the neck to the first of the two front sections.

* * * * *